US008565462B2

(12) United States Patent
Fideler et al.

(10) Patent No.: US 8,565,462 B2
(45) Date of Patent: Oct. 22, 2013

(54) METHOD AND APPARATUS FOR A HEARING ASSISTANCE DEVICE WITH PINNA CONTROL

(75) Inventors: Brian Fideler, Jordan, MN (US); Sidney A. Higgins, Maple Grove, MN (US); Michael Karl Sacha, Chanhassen, MN (US); Thomas Howard Burns, Chaska, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1330 days.

(21) Appl. No.: 11/689,358

(22) Filed: Mar. 21, 2007

(65) Prior Publication Data

US 2008/0232627 A1 Sep. 25, 2008

(51) Int. Cl.
*H04R 25/00* (2006.01)

(52) U.S. Cl.
USPC ..... 381/330; 381/327; 381/324

(58) Field of Classification Search
USPC ..... 381/312, 314, 322, 323, 324, 327, 328, 381/329, 330, 381
See application file for complete search history.

(56) References Cited

U.S. PATENT DOCUMENTS

| | | | | |
|---|---|---|---|---|
| 2,882,348 | A * | 4/1959 | Erickson | 381/330 |
| 2,975,244 | A * | 3/1961 | Lehr | 381/330 |
| 3,101,155 | A * | 8/1963 | Lehr et al. | 220/4.02 |
| 4,955,729 | A | 9/1990 | Marx | |
| 5,341,433 | A | 8/1994 | Meyer et al. | |
| 5,365,593 | A | 11/1994 | Greenwood et al. | |
| 7,027,608 | B2 * | 4/2006 | Fretz et al. | 381/330 |
| 7,082,207 | B2 * | 7/2006 | Rapps | 381/381 |
| 7,221,769 | B1 * | 5/2007 | Jorgensen | 381/328 |
| 7,369,671 | B2 * | 5/2008 | Sacha et al. | 381/331 |
| 7,599,508 | B1 * | 10/2009 | Lynch et al. | 381/330 |
| 8,154,829 | B2 * | 4/2012 | Carey et al. | 360/324.2 |
| 2002/0085729 | A1 * | 7/2002 | Marx | 381/330 |
| 2003/0094355 | A1 | 5/2003 | Angst | |
| 2004/0052392 | A1 * | 3/2004 | Sacha et al. | 381/331 |
| 2004/0062410 | A1 | 4/2004 | Wagner et al. | |
| 2005/0238190 | A1 | 10/2005 | Rohrlein | |
| 2005/0253814 | A1 | 11/2005 | Ghassabian | |

(Continued)

FOREIGN PATENT DOCUMENTS

| | | | |
|---|---|---|---|
| EP | 2043389 | A2 | 9/2008 |
| WO | WO-2007052189 | A2 | 5/2007 |
| WO | WO-2009118221 | A1 | 10/2009 |

OTHER PUBLICATIONS http://www.peratech.com/qtcmaterial.php.*

(Continued)

*Primary Examiner* — Mohammad Islam
*Assistant Examiner* — Phylesha Dabney
(74) *Attorney, Agent, or Firm* — Schwegman, Lundberg & Woessner, P.A.

(57) ABSTRACT

One embodiment of the present subject matter provides an apparatus for disposition between a pinna and a head of a user, the apparatus including a behind-the-ear housing, the housing having a first lateral side located adjacent the user's ear and a second lateral side located adjacent the side of the user's head when the apparatus is worn as directed, hearing assistance electronics disposed in the behind-the-ear housing, and a control disposed on at least one lateral side of the behind-the-ear housing, the control coupled to the hearing assistance electronics.

20 Claims, 2 Drawing Sheets

(56) References Cited

U.S. PATENT DOCUMENTS

| | | | | |
|---|---|---|---|---|
| 2006/0013420 | A1* | 1/2006 | Sacha | 381/312 |
| 2006/0284853 | A1 | 12/2006 | Shapiro | |
| 2007/0127757 | A2* | 6/2007 | Darbut et al. | 381/330 |
| 2008/0013769 | A1* | 1/2008 | Sacha et al. | 381/345 |
| 2008/0232627 | A1* | 9/2008 | Fideler et al. | 381/330 |
| 2009/0087004 | A1 | 4/2009 | Boguslavskij | |

OTHER PUBLICATIONS

"European Application Serial No. 08250924.1, Office Action mailed Apr. 8, 2011", 5 Pgs.
"European Application Serial No. 08250924.1, response filed Jul. 25, 2011 to Office Action mailed Apr. 8, 2011", 10 pgs.
"European Application Serial No. 08250924.1, European Search Report mailed Jul. 3, 2008", 7 pgs.

* cited by examiner

METHOD AND APPARATUS FOR A HEARING ASSISTANCE DEVICE WITH PINNA CONTROL

TECHNICAL FIELD

This disclosure relates to devices which assist hearing, and more specifically to method and apparatus for a pinna control for a hearing assistance device.

BACKGROUND

The ability to adjust operational parameters of a hearing assistance device is a feature of the device that is both useful and desirable. For example, users have benefited from the ability to adjust the volume of a hearing assistance device.

Hearing assistance devices employ different types of controls to assist the user in making operational adjustments. Hearing assistance devices that are small and discreet are attractive to most users of such devices. However, providing controls on small devices requires the user to have a good level of dexterity. Furthermore, physical features of a hearing assistance device, such as the microphone hood, can be confused with a pushbutton or other control, especially for user's with limited dexterity. A design which addresses these concerns, and which is inexpensive to manufacture, is desired. Additional opportunities for improvement in hearing assistance device controls resides in limiting susceptibility of a user control to allow moisture into the housing of the hearing assistance device and to make the appearance and use of any control as discreet as possible.

SUMMARY

The above-mentioned problems and others not expressly discussed herein are addressed by the present subject matter and will be understood by reading and understanding this specification.

The present subject matter relates to hearing assistance devices with user controls positioned about the housing of the hearing assistance device such that the control is activated by applying pressure to the control indirectly through the pinna of the user's ear. One embodiment of the present subject matter includes a behind-the-ear hearing assistance device with a housing and a user control located on a lateral side of the housing. In various embodiments, the "pinna" control is actuated by depressing the pinna of a user's ear when the hearing assistance device is worn by the user as directed. In additional embodiments, the pinna control is adjacent the side of the user's head. The pinna control enables the user to cycle through or select preset operational values of the hearing assistance device to adapt performance of the device to the user's requirements.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their legal equivalents.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Figure 1:
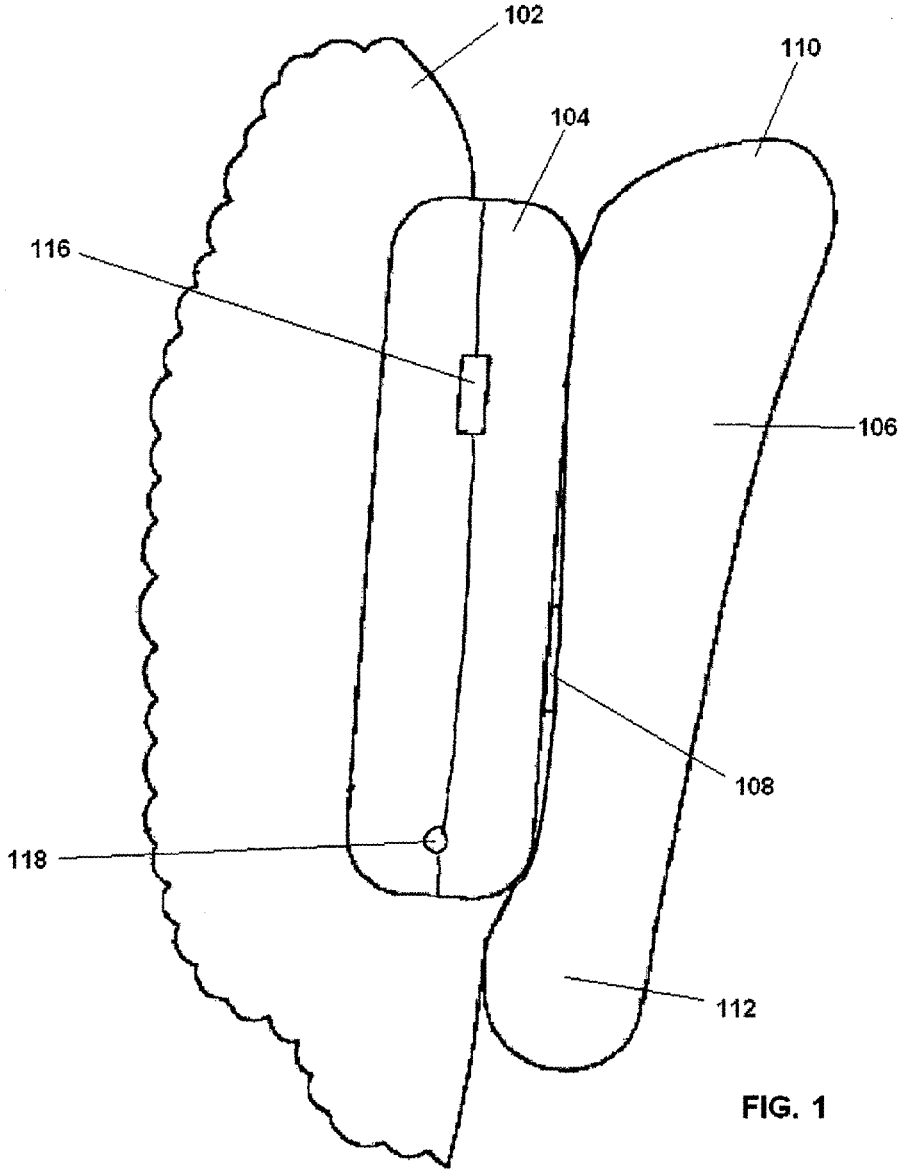
FIG. 1 is a back view of a hearing assistance device worn by a user, according to one embodiment of the present subject matter.

FIG. 1 illustrates a hearing assistance device 104, according to various embodiments, as worn by a user. FIG. 1 illustrates a perspective view of the hearing assistance device 102 from behind the user's ear 110. FIG. 1 shows a portion of the users head 102 and ear 110, including the pinna 106 and ear lobe 112, as well as, the hearing assistance device 104. The illustrated hearing assistance device includes a "pinna" control 108, a microphone port 116 and a second pushbutton 118. In the illustrated embodiment, the pinna control is located along the side of the hearing assistance device adjacent the pinna of the ear. The user operates the control by pushing on the pinna of the ear. The large footprint of the pinna control allows the user a substantially larger target to apply pressure to activate the control interface compared with traditional hearing assistance device controls. Such a target gives users with diminished dexterity or loss of feeling a more conducive interface to assist in the operation of their hearing assistance device. Additionally, the location of the control reduces problems associated with confusing a desired control interface with a physical feature of the hearing assistance device or a different control interface. In various embodiments, multiple pinna controls are used on a hearing assistance device and are activated by pressing on different portions of the pinna. Additional embodiments include controls positioned on the lateral side of the hearing assistance device adjacent the ear lobe, as well as, on the lateral side of the hearing assistance device adjacent the user's head.

In the embodiment of FIG. 1, the design of the hearing assistance device 104 provides two controls. The pinna control 108 is located adjacent the pinna and a second control 118 is located at the rear of the hearing assistance device. In the illustrated example, a user can easily distinguish between operating control 118 and operating the pinna control 108 as the axis of operation of each of the controls is perpendicular to one another. Therefore, the present subject matter does not require a prolonged time to discern between multiple controls or physical features of a hearing assistance device. Additionally, the pinna control 108 is operated by applying force to the pinna 106 while the second control 118 requires pressure to be applied directly to the control. Therefore, operation of the pinna control is discreet as it appears as though the user is touching their ear.

Figure 2:
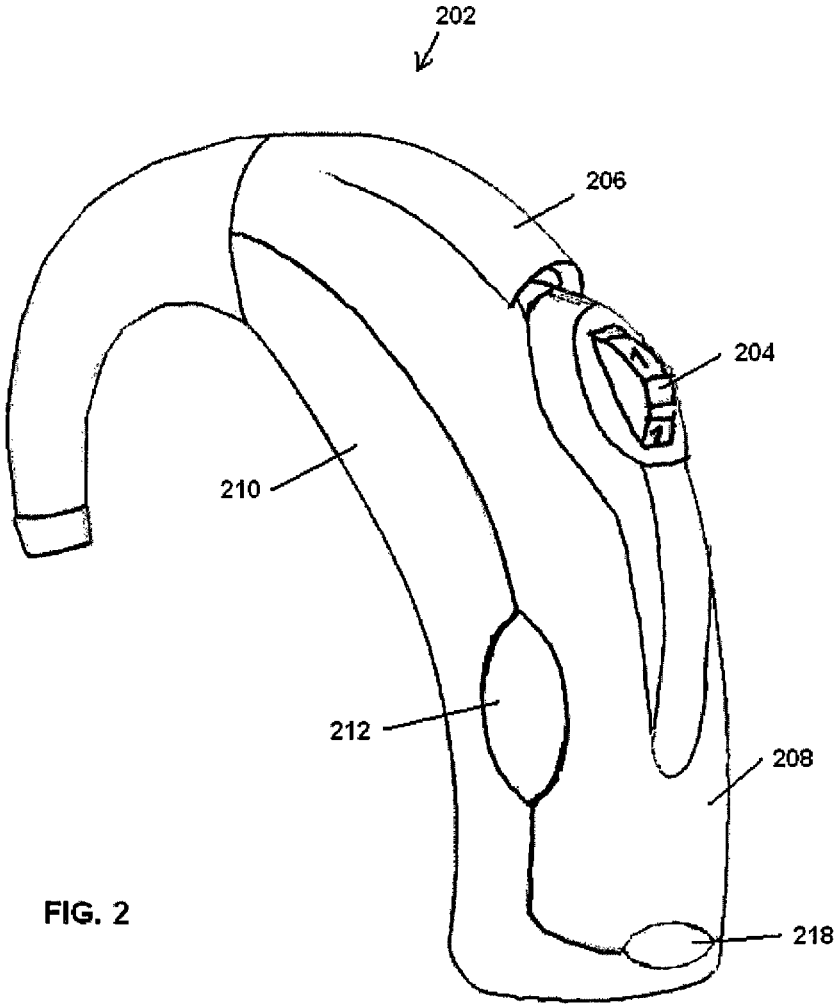
FIG. 2 is a perspective view of a hearing assistance device, according to one embodiment of the present subject matter.

FIG. 2 is a perspective view of a hearing assistance device 202, according to various embodiments of the present subject matter. The illustrated hearing assistance device 202 includes a microphone hood 206, a volume adjustment 204, a first shell member 208, a second shell member 210, a pinna control 212 and a second control 218. The pinna control 212 is adapted to connect with control electronics disposed in the hearing assistance device 202. In various embodiments, the pinna control 212 is configured to perform one or more functions including, but not limited to: power toggle, muting, BLUETOOTH compatible pairing, BLUETOOTH compatible switchhook operation, telecoil operation, volume level selection, noise filter selection, frequency dependent amplification profile selection, and other functions and parameters common to hearing assistance device operation.

In FIG. 2, the illustrated pinna control 212 is disposed in an aperture defined by cut-outs in a first shell piece 208 and in a second shell piece 210. The illustrated pinna control 212 is low profile. A low profile control improves patient comfort and the control's aesthetics. A low profile control, in general requires a larger footprint than a control without a low profile. Aesthetics are improved, for example, in diminishing the visual presence of the control through the use of a low profile control, the use of a flesh colored control or the use of a low profile, flesh colored control. In various embodiments, the pinna control 212 is made from a soft material compatible with positioning against a user's skin. Examples of such materials include rubber and plastic.

In various embodiments, the pinna control is spring loaded to operate with a low activation force. In various embodiments the pinna control operates as a pushbutton, to provide a momentary input to the enclosed hearing assistance electronics. In other examples, the pinna control operates as a toggle button providing a maintained input to the enclosed hearing assistance electronics on every other operation of the pinna control. In various embodiments, the control is made with a quantum tunneling composite which performs like a traditional mechanical switch. With a quantum tunneling composite, resistance through the composite remains high when no pressure is applied to the composite. Electrically, the circuit connected to the control remains open. When pressure is applied to the composite, the resistance through the composite lowers and the closing the circuit and providing an input signal to the hearing assistance electronics. Examples of quantum tunneling composites include QTC Switch Substrates made by Peratech.

This application is intended to cover adaptations or variations of the present subject matter. It is to be understood that the above description is intended to be illustrative, and not restrictive. The scope of the present subject matter should be determined with reference to the appended claims, along with the full scope of equivalents to which such claims are entitled.

What is claimed is:

1. An apparatus worn between a pinna and a head of a user, the apparatus comprising:

hearing assistance electronics;

a housing having a first lateral side and a second lateral side opposed to the first lateral side, the housing containing the hearing assistance electronics; and a control positioned on the first lateral side and adapted to reside proximal the pinna when worn, the control adapted to switch upon sensing pressure applied to it on the first lateral side as a result of the user pressing the pinna, the control electrically connected to the hearing assistance electronics and the control comprising a quantum tunneling composite material configured to close a circuit connected to the hearing assistance electronics by decreasing electrical resistance through the quantum tunneling composite material when pressure is applied to the control.

2. The apparatus of claim 1, wherein the control includes a switch and is disposed in an aperture of the housing.

3. The apparatus of claim 2, wherein the switch is normally open.

4. The apparatus of claim 1, wherein the control includes a flesh-colored control.

5. The apparatus of claim 1, wherein the control includes a rubber cover.

6. The apparatus of claim 1, wherein the control includes a plastic cover.

7. The apparatus of claim 1, wherein the control is switchhook electronics compatible with the BLUETOOTH standard.

8. The apparatus of claim 1, wherein the control is adapted to control power to the hearing assistance electronics.

9. The apparatus of claim 1, wherein the control is adapted to control telecoil electronics.

10. The apparatus of claim 1, wherein the control is a volume control.

11. The apparatus of claim 1, wherein the control is a mode selector.

12. The apparatus of claim 1, wherein the control is a parameter selector.

13. The apparatus of claim 1, wherein the control is spring loaded.

14. The apparatus of claim 1, wherein the control is configured to select an operating mode of the hearing assistance electronics when pressure is applied to the control.

15. A hearing assistance system worn between a pinna and a head of a user, the system comprising:

hearing assistance electronics; and a housing for the hearing assistance electronics including:

means for selecting an operating mode of the hearing assistance electronics when the pinna is depressed, wherein the means comprises a quantum tunneling composite material configured to close a circuit connected to the hearing assistance electronics by decreasing electrical resistance through the quantum tunneling composite material when pressure is applied to the control.

16. The system of claim 15, wherein the means for selecting an operating mode of the hearing assistance electronics when the pinna is depressed is disposed in a side of the housing adjacent the user's ear.

17. The system of claim 15, wherein the means for selecting an operating mode of the hearing assistance electronics when the pinna is depressed is disposed in a side of the housing adjacent the user's head.

18. A method comprising:

providing a behind-the-ear hearing assistance device housing with a first lateral side and a second lateral side, the second lateral side opposite the first lateral side;

placing hearing assistance electronics in the hearing assistance device housing;

placing a control in the first lateral side of the hearing assistance housing, wherein placing the control in the first lateral side of the hearing assistance housing includes providing the location of the control in the first lateral side of the housing is proximate a pinna when the housing is worn by a user, wherein the control is adapted to switch upon sensing pressure applied to it on the first lateral side as a result of the user pressing the pinna, the control comprising a quantum tunneling composite material configured to close a circuit connected to the hearing assistance electronics by decreasing electrical resistance through the quantum tunneling composite material when pressure is applied to the control; and connecting the control to the hearing assistance electronics.

19. The method of claim 18, wherein placing a control in the first lateral side includes selecting an operating mode of the hearing assistance electronics when the control changes state.

20. The method of claim 18, wherein placing a control in the first lateral side includes programming the hearing assistance electronics to adjust a hearing assistance parameter when the control changes state.

* * * * *

UNITED STATES PATENT AND TRADEMARK OFFICE

CERTIFICATE OF CORRECTION

PATENT NO. : 8,565,462 B2
APPLICATION NO. : 11/689358
DATED : October 22, 2013
INVENTOR(S) : Fideler et al.

It is certified that error appears in the above-identified patent and that said Letters Patent is hereby corrected as shown below:

On Title page 2, Item (56), under "Other Publications", line 3, delete "response" and insert --Response--, therefor Signed and Sealed this
Eleventh Day of November, 2014

Michelle K. Lee

Michelle K. Lee
*Deputy Director of the United States Patent and Trademark Office*